United States Patent [19]

Yamauchi et al.

[11] Patent Number: 4,848,733

[45] Date of Patent: Jul. 18, 1989

[54] VEHICLE JACK ASSEMBLY

[75] Inventors: Nobuhiro Yamauchi, Kariya; Koichi Yoshie, Toyota, both of Japan

[73] Assignees: Aisin Seiki Kabushiki Kaisha; Toyota Jidosha Kabushiki Kaisha, Japan

[21] Appl. No.: 115,861

[22] Filed: Nov. 2, 1987

[30] Foreign Application Priority Data

Nov. 4, 1986 [JP] Japan ..... 61-169287

[51] Int. Cl.[4] ..... B66F 3/22

[52] U.S. Cl. ..... 254/126

[58] Field of Search ..... 254/122, 126, 98, 7 R, 254/7 B, 7 C

[56] References Cited

U.S. PATENT DOCUMENTS 4,695,036 9/1987 Yukimoto et al. ..... 254/126

*Primary Examiner*—Robert C. Watson

*Attorney, Agent, or Firm*—Finnegan, Henderson, Farabow, Garrett & Dunner

[57] ABSTRACT

A vehicle lifting jack assembly having a pantographic mechanism carrying a head bracket for engagement with a jack point formed in a vehicle body. The head bracket is formed with a first groove extending in one direction for accommodating a downwardly projecting flange portion of the vehicle body so that the head bracket can be engaged with a lower surface portion of the vehicle body at the opposite sides of the flange portion. The head bracket is further formed with a second groove which extends perpendicularly to the first groove for engagement with a support bracket provided in the vehicle body for storing the jack assembly in the vehicle body.

3 Claims, 3 Drawing Sheets

VEHICLE JACK ASSEMBLY

BACKGROUND OF THE INVENTION

1. Field of the Invention

The present invention relates to a vehicle lifting jack for supporting the vehicle body above the ground, and more particularly to a jack of a screw type.

Description of the Prior Art

A conventional screw type vehicle jack generally includes a base and a pantographic mechanism having a lower end pivotably connected with the base and an upper end supporting a head bracket for engagement with the vehicle body. More specifically, the pantographic mechanism includes a pair of lower arms which are pivotably connected with the base at the lower ends and a pair of upper arms connected at the lower ends respectively with the upper ends of the lower arms and carrying a head bracket at the upper ends. The lower and upper arms form a pantographic mechanism so that the vertical distance between the base and the head bracket is changed by adjusting the horizontal distance between the connections of the respective lower and upper arms.

In order to change the distance between the connection of the upper end of one lower arm and the lower end of one upper arm and the connection of the upper end of the other lower arm and the lower end of the other upper arm, there is provided at one of the connections a nut member having internal screw threads. A screw shaft is inserted through the nut member and one end of this shaft is rotatably connected with the other connection. Thus, a rotation of the screw shaft in opposite direction causes one of the connections between the lower and upper arms to horizontally move toward or away from the other connection, and the height of the head bracket is varied in response to this rotation of the screw shaft.

Usually, the head bracket is so designed that it is suitable for engagement with a jack point formed at lower edge portions of the side sill of the vehicle body. In general, the side sill of the vehicle body is formed by welding suitably formed sheet metal parts into a structure of a closed cross section. The side sill parts have welding flanges which extend along the lower portion of the side sill and substantially flat portions of limited width are provided at the opposite sides of the connecting flanges.

According to one form of the conventional structure, the head bracket is designed so that it is engaged at the upper surface with the connecting flanges of the side sill. In another form, the head bracket is formed with a groove for accommodating the connecting flanges so that the head bracket is engaged at the upper surface with the flat portions of the side sill. It should however be noted that in the structure wherein the head bracket is engaged with the connecting flanges of the side sill, the load supporting the vehicle body is concentrated to a very limited portion of the side sill so that the side sill connecting flanges may be easily deformed. In the structure having a groove for accommodating the side sill connecting flanges so that the head bracket can engage the flat portions of the side sill, the supporting load may be distributed to a relatively wide area of the side sill, however, there arises another problem in connection with the manner of storing the jack in the vehicle body.

Usually, the screw type vehicle jack is stored in a trunk of the vehicle body along a side or rear wall or along a floor panel. In storing the jack in this way, the jack is firmly held in position by having the base engaged with a support bracket provided on the wall along which the jack is stored. There is further provided on the wall a second bracket with which the head bracket is engaged at the groove. In this storing position, it is required that the groove in the head bracket is in the direction substantially parallel with the direction of the screw shaft. It should however be noted that in using the jack the direction of the groove must be perpendicular to the direction of the screw shaft. For the reasons described above, the conventional structure of this type is designed so that the head bracket is rotatable about an axis perpendicular to the screw shaft. The structure is however disadvantageous in that the rotatable connection of the head bracket is not strong enough so that this connection may be inadvertently broken in case where the jack is inclined in use.

Japanese utility model publication No. 52-7626 discloses a jack structure having a head bracket formed with a groove for accommodating the connecting flanges of the side sill. In the structure proposed by the utility model, the head bracket is formed integrally with a portion on which the upper arms of the pantographic mechanism are pivotably connected. The structure proposed by the utility model is, however, disadvantageous in that the groove in the head bracket is not engaged with the aforementioned second bracket in the storing position so the jack is not held firmly in the storing position.

SUMMARY OF THE INVENTION

It is an object of the present invention to provide a vehicle lifting jack of a screw type which is easy to handle but does not produce any deformation of the vehicle body structure.

Another object of the present invention is to provide a vehicle jack which can be firmly held on the vehicle body in the stored position.

A further object of the present invention is to provide a vehicle jack of a screw type which has a head bracket formed with a groove for accommodating connecting flanges of a side sill so that the supporting load is distributed in a relatively wide area on the lower portion of the side sill but can be firmly held on the vehicle body in the stored position.

A still further object of the present invention is to provide a vehicle lifting jack of a screw type in which the head bracket is secured to the pantographic mechanism so that there will be little possibility of the head bracket being broken off during use.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

According to the present invention, the above and other objects can be accomplished by a vehicle jack assembly including a base, pantographic means having a lower end portion connected to the base and an upper end portion carrying a head bracket, said pantographic means including a screw shaft, extending in a first direction, for operating the pantographic means to cause the head bracket to move toward and away from the base, said head bracket having a first groove extending perpendicularly to said first direction for engagement with a portion of a vehicle body, said first groove having a configuration in which its width increases toward each end of the groove, and a second groove extending substantially in said first direction for engagement with a bracket provided in said vehicle body for storing the jack assembly.

The head bracket means is preferably secured to the upper end portion of the pantographic means. The first groove of the head bracket may be of a configuration defined by a pair of arcuate walls which are opposed so that the groove is increased in width toward each end of the groove.

The principles of the present invention will be explained by the following descriptions of a preferred embodiment taking reference to the accompanying drawings.

DESCRIPTION OF THE PREFERRED EMBODIMENT

Figure 1:
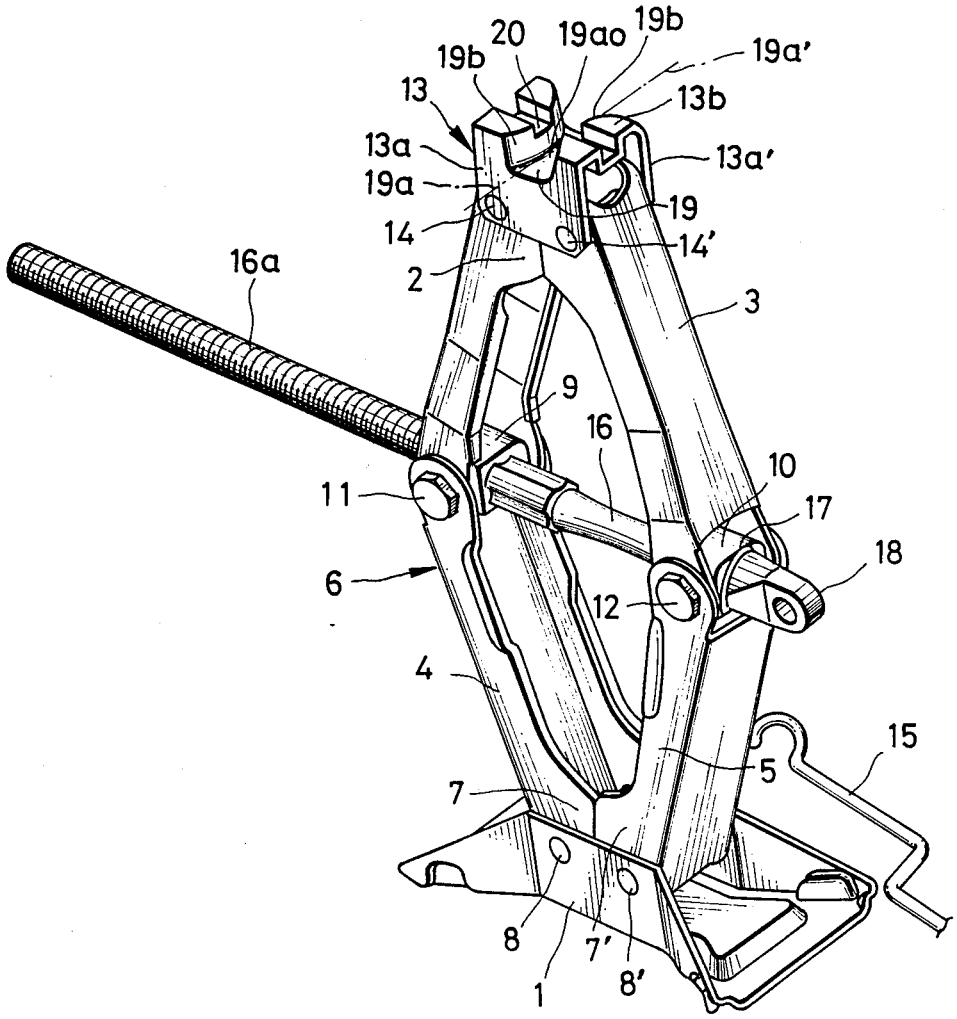
FIG. 1 is a perspective view of a vehicle jack assembly constructed in accordance with the preferred embodiment of the present invention.

Referring to the drawings, particularly to FIG. 1, there is shown a vehicle lifting jack assembly including a base 1 connected with a lower portion of a pantographic mechanism 6. The pantographic mechanism 6 has a pair of upper arms 2 and 3 and a pair of lower arms 4 and 5. The lower arms 4 and 5 have lower ends 7 and 7', respectively, which are pivotably connected with vertical side wall portions of the base 1 through pivot pins 8 and 8'. The upper arms 2 and 3 and the lower arms 4 and 5 are of a channel-shaped cross-section and the lower arms 4 and 5 have upper ends respectively connected with lower ends of the upper arms 2 and 3 by means of pivot shafts 11 and 12, respectively. The upper arms 2 and 3 have an upper ends pivotably connected with a head bracket 13, respectively through pivot pins 14 and 14'.

The pivot pin 11 is formed integrally with a nut 9 which has an internally screw threaded hole extending in a direction of a straight line passing through centers of the pivot pins 11 and 12. The pivot pin 12 is formed with a bearing block 10 providing a thrust bearing 17. A screw shaft 16 is provided and has a externally screw threaded portion **16*a* engaged with the internally screw threaded hole of the nut 9. The screw shaft 16 is further journalled at one end by the thrust bearing 17 formed in the bearing block 10. At this end of the screw shaft 16, there is formed an eye fitting portion 18 for engagement with an operating handle which is used for rotating the screw shaft 16**.

The head bracket 13 is a one-piece structure made of sheet metal. The head bracket 13 has a pair of side walls **13*a* and 13*a'* and a top wall 13*b*. In the top wall 13*b* of the head bracket 13, there is formed a first groove 19 having an axis 19*a* extending perpendicularly to the direction of the screw shaft 16. The groove 19 is defined by a pair of vertical walls 19*b* of an arcuate convex configuration which are opposed to each other as shown. Thus, the groove 19 is of a configuration in which the width of the groove 19 increases toward each end of the groove 19. The head bracket 13 is further formed with a second groove 20 which extends in the direction perpendicular to the axis 19*a* of the first groove 19. In other words, the second groove 20 extends parallel with the screw shaft 16. The second groove 20 is smaller in depth than the first groove 19**.

Figure 2:
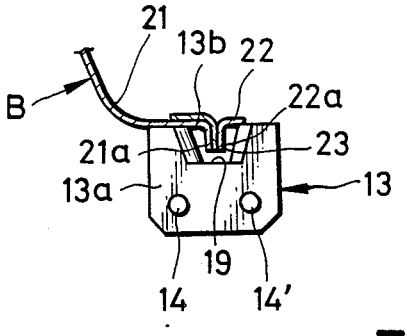
FIG. 2 is a sectional view showing the manner of use of the jack assembly shown in FIG. 1.

Referring now to FIG. 2, it will be noted that the vehicle body B includes a side sill on each side of the body. The side sill is formed by an outer panel 21 and an inner panel 22 which are provided with connecting flanges **21*a* and 22*a*, respectively. the connecting flanges 21*a* and 22*a* are welded together to form a structure of a closed cross-section. The first groove 19 has a depth which is sufficient for accommodating the connecting flanges in the groove 19. It will therefore be understood that in use the upper surface 13*b* of the head bracket 13 is held in contact with the lower surfaces of the side sill at the opposite sides of the connecting flanges 21*a* and 22*a***.

Figure 5:
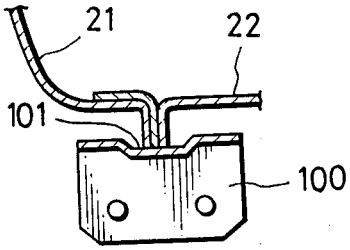
FIG. 5 is a sectional view similar to FIG. 2 but showing an example of the conventional structures.

FIG. 5 shows an example of the prior art in which the head bracket 100 of the jack assembly is formed at the top surface with a shallow groove 101 which is adapted to be engaged with the lower edge of the connecting flanges of the side sill. This structure is disadvantageous in that the connecting flanges of the side sill may be deformed under a possible concentration of the load on the jack assembly.

Figure 6:
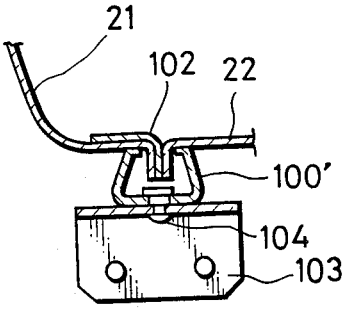
FIG. 6 is a sectional view showing another example of the prior art.
Figure 7:
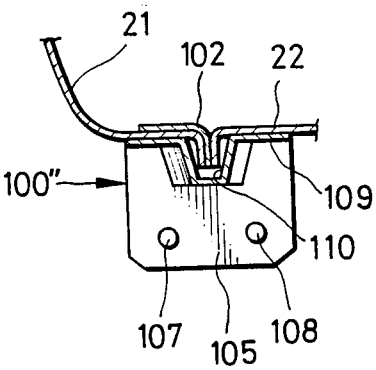
FIG. 7 is a sectional view showing a further example of the prior art.

FIG. 6 shows another example of the prior art in which the head bracket 100' is pivotably connected with a main bracket 103 by means of a pivot pin 104 so that the head bracket 100' can be oriented at any desired direction with respect to the base for use and for storing. The structure however has a problem of there being insufficient strength at the connection between the head bracket 100' and the main bracket 103. FIG. 7 shows the structure as proposed by the aforementioned Japanese utility model. This structure has a problem in securely holding the jack assembly during storage of the same.

According to the present invention, the first groove 19 is provided in a direction perpendicular to the direction of the screw shaft 16 and has the configuration in which the width of the groove increases toward each end thereof. Thus, there is a flexibility in positioning the jack assembly with respect to the vehicle body.

Figure 3:
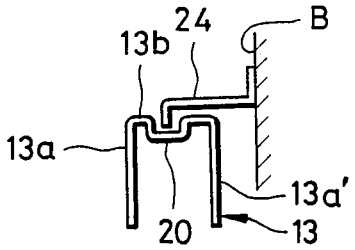
FIG. 3 is a fragmentary sectional view showing the jack assembly in the storing position.
Figure 4:
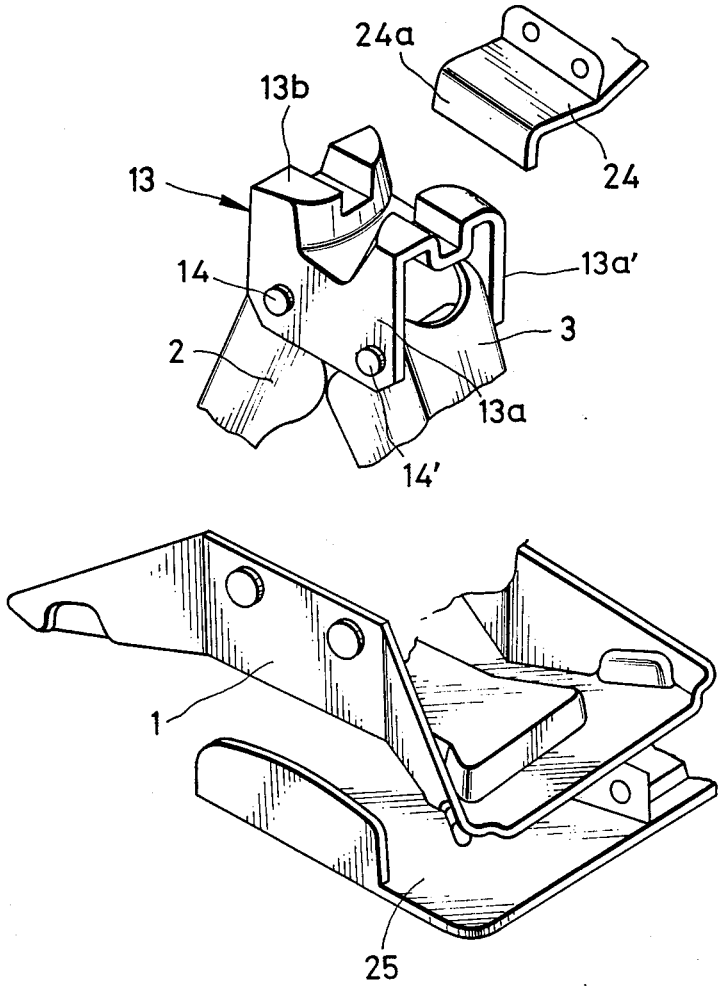
FIG. 4 is an exploded perspective view of the jack assembly shown in FIG. 1.

Referring to FIGS. 3 and 4, it will be noted that in storing the jack assembly in the vehicle body, the base 1 is positioned on a support bracket 25 provided on the vehicle body B for this purpose as shown in FIG. 4. The head bracket 13 is positioned against a second support bracket 24 which has a flange **24*a* adapted for engagement with the second groove 20 formed in the head bracket 13. Since the second groove 20 is directed substantially in parallel with the screw shaft 16, it is possible in placing the jack assembly in the storing position to conveniently use the jack screw 16. More specifically, the jack assembly is at first put in a fully covered position where the head bracket 13** is closest to the base 1 and the base 1 is positioned on the support bracket 25. Then, the handle (not shown) is actuated to make the screw shaft 16 rotate to bring the jack assembly into an extended position. The head bracket 13 is then brought into engagement with the support bracket 24 by having the second groove 20 engage the flange 24*a* so that the jack assembly is held firmly in the storing position. In this course of the operation, it is not required to change the orientation of the head bracket to make it aligned with the flange of the second support bracket.

The invention has thus been shown and described with reference to a specific embodiment, however, it should be noted that the invention is in no way limited to the details of the illustrated structures but changes and modifications may be made without departing from the scope of the appended claims.

We claim:

1. A vehicle jack assembly including a base; pantographic means having a lower end portion connected to the base and an upper end portion carrying a head bracket; said pantographic means including a screw shaft, extending in a first direction, for operating the pantographic means to cause the head bracket to move toward and away from the base; said head bracket having a first groove extending perpendicularly to said first direction for engagement with a portion of a vehicle body, said first groove having a configuration in which its width increases toward each end of the groove, and a second groove extending substantially in said first direction for engagement with bracket provided in said vehicle body for storing the jack assembly.

2. A jack assembly in accordance with claim 1 in which said head bracket includes a pair of convex, arcuate walls which are opposed with respect to each other, said walls defining said first groove.

3. A jack assembly in accordance with claim 2 in which the depth of said second groove is less than the depth of the first groove.

* * * * *